US005323549A

United States Patent [19]

Segel et al.

[11] Patent Number: 5,323,549

[45] Date of Patent: Jun. 28, 1994

[54] SHOE EQUIPPED WITH INTERNAL ORTHOTIC CRADLE DEVICE

[75] Inventors: Jerome D. Segel; Michelle A. Segel, both of Oak Bluffs, Mass.

[73] Assignee: Sports Licensing, Inc., Hanover, N.H.

[21] Appl. No.: 107,238

[22] Filed: Aug. 16, 1993

[51] Int. Cl.[5] ..... A43B 7/14

[52] U.S. Cl. ..... 36/140; 36/91; 36/92; 36/170

[58] Field of Search ..... 36/88, 89, 91, 92, 140, 36/145, 166, 169, 170; 602/27, 65, 66

[56] References Cited

U.S. PATENT DOCUMENTS

| | | | |
|---|---|---|---|
| 2,149,664 | 3/1939 | Brown et al. | 36/170 |
| 2,734,285 | 2/1956 | Levitt | 36/140 |
| 4,649,939 | 3/1987 | Curtis | 602/27 |
| 4,670,998 | 6/1987 | Pasternak | 36/89 |
| 5,269,078 | 12/1993 | Cochrane | 36/88 |

FOREIGN PATENT DOCUMENTS

| | | | |
|---|---|---|---|
| 10575 | 11/1933 | Australia | 36/170 |

*Primary Examiner*—Paul T. Sewell
*Assistant Examiner*—Marie Denise Patterson
*Attorney, Agent, or Firm*—Barry R. Blaker

[57] ABSTRACT

Disclosed herein is a dynamically interactive combination of a shoe and an externally adjustable internal orthotic foot cradle formed of a fabric strap material. The disclosed combination attenuates and beneficially disperses the deforming forces experienced by the foot in weight bearing, limits the extent of pronation and excursions of the various joints of the mid and hind foot during weight bearing and the cradle can store mechanical energy absorbed during weight bearing and return at least a portion of such stored energy in the form of restorative forces applied to the mid and hind foot during the non-weight bearing phase of the gait cycle.

18 Claims, 2 Drawing Sheets

SHOE EQUIPPED WITH INTERNAL ORTHOTIC CRADLE DEVICE

BACKGROUND OF THE INVENTION

The present invention relates broadly to footwear and is more particularly concerned with a shoe having disposed therewithin an orthotic cradle device.

In human locomotion the foot undergoes a highly complex and continuously changing series of motions, vectors and loads. The gait cycle of a human is generally considered as comprising two distinct phases: (a) the stance phase, and (b) the swing phase. The beginning of the stance phase is signalled by the heel strike of the foot against the support surface. At this point of the cycle the foot begins to become loaded with body weight and, in response, pronates, thereby to result in a lowering of the medial longitudinal arch, an outward turning of the foot and an inward rotation of the leg. During this pronation of the foot, the bony articulations or joints of the mid and hind foot loosen somewhat in order that the foot can both adjust to the support surface and absorb the mechanical shock of heel strike and weight bearing. As the plantar surface of foot rolls proximo-distally onto the support surface, and at some point subsequent to midstance, the heel begins to invert and the foot begins to resupinate. At this juncture of the stance phase the forefoot is fixed to the support surface with the heel in inversion, the heads of the first and fifth metatarsals are splayed apart and the foot is in a rigid structural condition and, ideally, in a neutral, that is to say, neither pronated nor supinated, position. Next, plantar-flexion of the foot begins, the arch becomes rigid and the heel lifts off the support surface, usually with accompanying further supination. The plantar fascia shortens and the toes begin to flex, creating a so-called "windlass effect" whereby the arch is elevated and which constitutes the final or "propulsive" segment of the stance phase immediately preceding the beginning of the swing phase of the gait cycle and the heel strike of the opposite foot. In the normal swing phase, during which the foot is lifted entirely off the support surface and, therefore, is in a non-weight bearing condition, the normal foot returns from its supinated position to a neutral position, as do the articulations of the fore, mid and hind foot, in preparation for the onset of its next stance or weight bearing phase.

Flexible biomechanical deformities and anomalies of the foot tend to decrease the foot's intrinsic resistance to weight bearing and environmental forces. Where this scenario is present, there is usually presented a predisposition of the medial longitudinal arch and the subtalar joint to excessive triplanar motion or pronation which can generally be observed by careful visual analysis of the gait cycle. Thus, the joint excursions involved in pronation of the foot which, as mentioned above, is a normal motion in the early portion of the stance phase can themselves be dimensionally excessive and/or the foot can fail to properly return from its pronated state to a fully neutral position in preparation for the onset of the propulsive segment of the stance phase. Accordingly, if left unresolved, these structurally destabilizing forces acting upon a biomechanically unsound foot result in hypermobility syndromes of the first and fifth metatarsals, plantar flexion and medial deviation of the talar head, as well as naviculo-cuneiform sag. Such hypermobility syndromes constitute forerunners to many multi-focal sub-acute, acute and chronic pathologies of the foot, including such conditions as hallux-abducto-valgus deformity, tailor's bunion, hellomata, degenerative joint disease, plantar fascial strain, heel spur syndrome, subluxation of the calcaneal-cuboid joint and lateral foot column problems. Such pathological foot conditions, particularly because they generally cause the sufferer thereof to compensate for foot pain or deformity by altering his or her gait, can also foster or exacerbate pathologies relating to portions of the human anatomy other than the foot, such as ankle, knee, hip and spine.

In view of the foregoing potential or actual problems associated with the hypermobile foot, orthotic devices have been developed which are said to stabilize the foot in order to prevent excessive pronation and/or to maintain the foot in an anatomically correct position within footwear during the gait cycle. Amongst these are various mid-hind foot stabilizing strap arrangements disclosed by R. Stephen Curtis in U.S. Pat. No. 4,461,288, issued Jul. 24, 1984 and U.S. Pat. No. 4,649,939, issued Mar. 17, 1987. Said strap arrangements are disclosed to be worn external to the shoe and are said to stabilize motion of the infratalar joints and prevent slippage of the foot within the shoe. These strap arrangements broadly comprise a dorsal strap, an Achilles strap and a plantar strap, said straps being joined together at one end to form a generally Y-shaped arrangement. The plantar strap is disposed under or through the sole, proximate the plantar fascia, the dorsal strap disposed over the instep and the Achilles strap disposed around the heel of the shoe, the free ends of the dorsal and Achilles straps comprising clasps such that their lengths may be adjusted while securing them under tension to the other end of the plantar strap. The completed construction defines an adjustable mid and hind foot-encircling retention harness disposed over the exterior of the shoe which, acting indirectly upon the foot through the shoe, is said to stabilize the bony articulations of the foot, particularly along the infratalar joints, thereby to prevent or mitigate against excessive pronation thereof, and to secure the foot within the shoe so as to avoid or minimize slippage of the foot within the shoe and to thereby avoid the loss of arch support by the shoe which is said to result as a result of such slippage. Apparently, the Curtis stabilizer requires the use of relatively unyielding and inelastic strapping materials, such as cotton polyester blend webbing, for its construction because, inter alia, patentee states that periodic readjustment of the straps may be required in order to accomodate the swelling of the foot which often occurs during the course of an exercise routine. Also indicative of the use of unyielding inelastic strapping materials in the construction of the Curtis stabilizers is the patentee's express intention that a force applied to any one of the straps be distributed to the remaining straps of the construction.

In accordance with the present invention there is provided a shoe comprising an internal orthotic cradle device which, unlike the external retention harnesses disclosed in the foregoing Curtis patents, interacts dynamically and both directly and indirectly upon the plantar anatomy of the foot.

OBJECTS OF THE INVENTION

It is a principal object of the invention to provide a novel shoe/orthotic device combination.

It is another object of the invention to provide a shoe equipped with a novel user adjustable internal orthotic cradle device adapted to control pronation and supination of the foot and pre- and post-weight bearing calcaneal positioning.

It is still another object of the invention to provide a shoe equipped with a user adjustable internal orthotic cradle device adapted to provide effective control of a greater proportion of the overall plantar anatomy than provided by orthotic devices of the prior art and including the medial and lateral aspects of said plantar anatomy as well as the medial and lateral longitudinal arch columns.

It is another object of the invention to provide a shoe equipped with a user adjustable internal elastic orthotic cradle device adapted to temporarily store energy therein due to stretching thereof during the course of the gait cycle and to at least partially return such stored energy in the form of restorative forces applied to the foot.

Other objects and advantages of the invention will, in part, be obvious and will, in part, appear hereinafter.

SUMMARY OF THE INVENTION

In accordance with the invention the orthotic cradle device thereof comprises a generally Y-shaped cradle composed of base leg, anterior arm and posterior arm strap members, the anterior and posterior arm members being joined to or integral with the medial end of the base leg member. The base leg member defines a plantar-lateral heel engagement strap and comprises a relatively wide medial plantar support portion and a relatively narrower lateral free end portion. The anterior arm member defines a medial longitudinal arch engagement strap and the posterior arm member defines a plantar-medial heel engagement strap. The cradle is disposed within the shoe upper with the plantar support portion of the base leg member being disposed in an oblique tranverse position across the plantar region of the floor of the shoe. The lateral free end portion of said base leg member courses upwardly along the inside of the lateral side of the upper, thereby to engage the calcaneal-cuboid joint of a foot received into the shoe, and slidingly passes to the exterior thereof through a slotted aperture located at a position proximal to the lateral aspect of the calcaneal-cuboid joint. The anterior arm member courses upwardly at an anterior angle (relative to the plantar support portion of the base leg member) along the inside of the medial side of the upper, thereby to hug the plantar and medial anatomy of the foot, and passes slidingly to the exterior of the upper through a slotted aperture located at a position at least approximately corresponding to the dorsomedial aspect of the medial longitudinal arch of a foot received into the shoe. The posterior arm member courses upwardly at a posterior angle (relative to the plantar support portion of the base leg member) along the inside of the medial side of the upper, thereby to engage the talo-calcaneal joint of the foot, and passes slidingly to the exterior of the upper through a slotted aperture located at a position at least approximately corresponding to the medial aspect of the calcaneus, inferior to the proximal extent of the malleolus. The free end portion of the base leg member exterior of the upper is secured, or comprises means to adjustably secure same, to the upper at a location spaced posteriorly of the slotted aperture associated therewith. The free end portion of said anterior arm member exterior of the upper is disposed laterally over the medial longitudinal arch of a foot residing within the shoe and is provided with means by which it may be adjustably secured to the upper at the medial longitudinal arch, dorsally or laterally thereto. The free end portion of said posterior strap member residing exterior the upper is provided with means by which it may be adjustably secured to the upper at a location spaced posteriorly of the aperture associated therewith. In a preferred embodiment of the invention and as will be explained in more detail hereinafter, the strap members defining the orthotic cradle device of the invention are elastic in nature and, in an even more preferred embodiment, have limited stretch characteristics.

DESCRIPTION OF THE PREFERRED EMBODIMENTS

Figure 1:
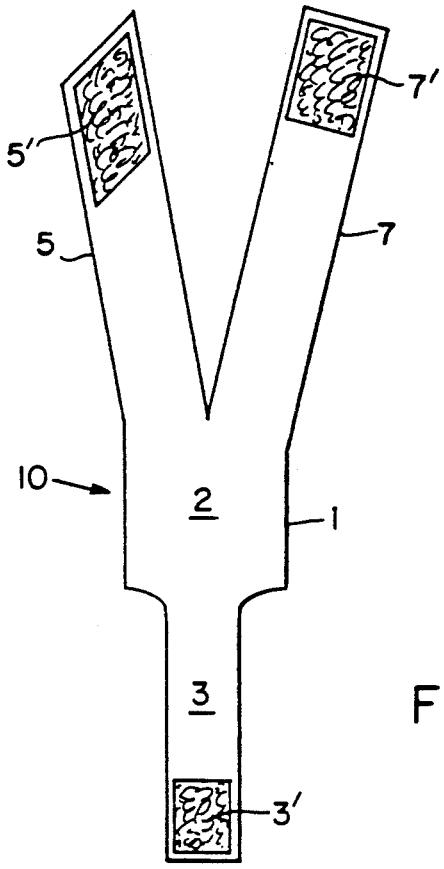
FIG. 1 hereof is a plan view of an orthotic cradle device in accordance with the invention.

The present invention can be effectively applied to substantially any shoe construction comprising a sole and an upper enclosing the mid and/or hind foot of the wearer. Thus, the invention is broadly applicable to dress and casual shoes, orthopedic shoes, suitably constructed sandals, work shoes and boots and the like. However, it is obvious that that the mechanical shock and anatomically deforming stress events suffered by the human foot are normally substantially exacerbated during athletic activities and that it is within this typically high stress and mechanical shock environment of athletics that the foot is particularly prone to undergo excessive stress and deformation and to exhibit injurious hypermobility syndromes. Accordingly, the present invention is particularly suited for use in conjunction with athletic shoes or boots which typically comprise a molded rubber sole construction, a fully enclosing and centrally tongued upper and, in many instances a removable molded foot bed disposed on the interior floor of the sole, said foot bed being composed of a compliant, but resilient, cellular rubber or elastomeric material.

Referring to the drawing hereof, wherein like reference numerals in the Figures refer to like structures, there is shown a generally Y-shaped orthotic cradle device 10 suspended within an athletic shoe 50. The orthotic cradle device 10 is composed of a fabric strap material and comprises a base leg member 1 defining a plantar-lateral heel engagement strap. Said base leg member 1 has a relatively wide medial plantar support portion 2 defining a plantar mid foot cradle and a relatively narrow lateral free end portion 3, that section of end portion 3 which resides within the shoe engaging the calcaneal-cuboid joint and the exterior section of which is adapted to engage the heel counter of the shoe. The widths of the respective plantar support and free end portions 2 and 3 of base leg member 1 are usually non-critical and are, therefore, subject to considerable variation. In general, for the adult foot, it can be said that the width of the medial plantar support portion 2 will generally be within the range of from about 1.5 to about 3 inches (38–77 mm) and the width of the lateral free end portion 3 will generally be within the range of from about 0.5 to about 1.0 inch (12–26 mm). Extending at an anterior angle from the medial end of said medial plantar support portion 2 of base leg member 1 is anterior arm member 5, defining a medial longitudinal arch engagement strap. The width of said anterior arm member can be from about 0.5 to about 3 inches (12–77 mm), it being our preference that said arm member have a width of at least 1.75 inches (44 mm) in order to assure that a substantial area of the medial longitudinal arch of the foot be captured thereunder. Extending at a posterior angle from the medial end of said medial plantar support portion of base leg member 1 is posterior arm member 7, defining a plantar-medial heel engagement strap. The width of said posterior arm member 7 is generally non-critical, provided that it is sufficient to carry the loads imposed thereon during service. Generally speaking, a width for the arm member 7 of between about 0.5 and about 1 inch (12–26 mm) will be adequate. The respective arm members of the orthotic cradle device 10 may be individually cut and secured together, such as by sewing, or, as shown, the entire cradle may be cut from a single piece of suitable fabric material. Alternatively, any combination of sewing of individual arm members to precut arm members can also be utilized.

With respect to the fabric material of construction utilized for the orthotic cradle device 10 substantially any strap material capable of withstanding the environmental and physical loads imposed thereupon in in-shoe service can be found to be suitable and to provide at least some of the orthotic benefits available from the practice of the invention. Accordingly, even the relatively unyielding, inelastic fabric materials comprehended in the aforementioned Curtis patents may be found broadly suitable in the practice of the present invention. However, it is distinctly preferred that the material of construction utilized in the fabrication of the orthotic cradle device 10 be elastic in nature, that is, that said material may be elongated or stretched by application of a load thereto, such as is imposed by the foot on the cradle device 10 during weight bearing and, upon release of the load therefrom, recover fully to its original, unloaded length, such as occurs in the swing phase of the gait cycle. For instance, various surgical elastic bandaging materials have been found to constitute generally excellent materials of choice for fabrication of the orthotic cradle device 10. We have found that when said cradle device is fabricated of such an elastic fabric material there is provided enhanced comfort and substantial allowance for normal foot function and shock absorption while promoting proper foot positioning and stress dispersement and providing for the anatomically restorative energy return benefit mentioned hereinbefore. Even further preferred for use as the material of construction of the orthotic cradle device 10 is an elastic fabric material having limited stretch characteristics. In this regard, we prefer a material which, while possessed of the property of elasticity, also has an ultimate elongation, when loaded to its tensile limit, of from about 110 to about 120% of its original length. Such limited stretch fabrics can generally be prepared by appropriate selection of fiber and thread materials and weaving regimens. For instance, the warp of the fabric may be composed of elastic yarns or threads blended with loosely woven inelastic yarns or threads, said loosely woven inelastic yarns or threads being tightened to their stretch limits upon stretching of the fabric and thereby serving to limit the ultimate elongation properties of the overall fabric to within the above range. An alternate method for limiting the stretch characteristics of an elastic fabric material is to sew a stretch limiting stitch pattern therethrough, using inelastic thread.

Referring now particularly to FIGS. 2 through 5 hereof, there is shown the orthotic cradle device 10 disposed and suspended within the upper 54 of an athletic shoe 50 whose construction details are generally representative of athletic shoes currently of commerce. Said shoe comprises a molded rubber sole 52 and a foot enclosing upper 54, said upper having a central free tongue 56 affixed thereto only at the distal end of said tongue and the usual lacing closure 58 disposed over the longitudinal center line of the shoe. Disposed within the upper 54, over the floor of the insole 60, is a removable molded foot bed 62 composed of a resilient cellular polymer material.

The upper 54 is provided with a number of slotted apertures therethrough which are anatomically located with respect to a foot received into the upper and which are adapted to slidingly receive the strap members of the Y-shaped orthotic cradle device 10 therethrough. Slotted aperture 64 is provided on the lateral side of the upper 54 (FIG. 3) at location proximal and superior to the lateral aspect of the calcaneal-cuboid joint. Said slotted aperture 64 is preferably obliquely oriented at an anterior angle relative to the horizontal axis of the shoe so as to facilitate the intended sliding adjustment of the lateral free end portion 3 of leg member 1 received therethrough. The medial side of the upper 54 (FIG. 2) is provided with a slotted aperture 66 at a location corresponding to the medial aspect of the calcaneus, inferior to the proximal extent of the malleolous. It is desirable that the slotted aperture 66 also be obliquely oriented at an anterior angle relative to the horizontal axis of the shoe so as to facilitate sliding adjustment of the posterior arm member 7 of the orthotic cradle device 10 received therethrough. Finally, the medial side of the upper 54 also comprises a slotted aperture 68 adapted to slidingly receive the anterior arm member 5 of the orthotic cradle device 10 therethrough, said aperture 68 being located at about the dorsomedial aspect of the medial longitudinal arch. As will be noted from FIG. 5, in many shoe constructions the medial edge 57 of a central free tongue 56 can also lie along the dorsomedial aspect of the medial longitudinal arch. Where this circumstance exists, where the tongue is "free" by being attached to the upper only at its distal end and where the lacing 58 is sufficiently spaced apart to admit the anterior arm member 5 therethrough, the slotted aperture 68 can also take the form of the slotted space inherently defined between the medial edge 57 of the free tongue 56 and that portion of the upper's counter overlying said medial edge 57. Thus, where these foregoing structural details of the upper 54 attend, the anterior arm member 5 of the orthotic cradle device 10, in lieu of being received through a separate and distinct aperture 68, as expressly shown, can instead, be slidingly received and reeved to the exterior of said upper through the slotted space defined between said tongue 56 and that portion of the upper 54 overlying same.

Upon exiting to the exterior of the upper 54 through the slotted aperture 64 the lateral free end portion 3 of base leg member 1 is directed posteriorly of said aperture and is secured to the upper 54 at a spaced distance posteriorly thereof, preferably at or posteriorly of that portion of the lateral side of the heel 53 whereat said lateral side begins to curve medially toward the longitudinal center line of the heel. Preferably, the means by which said lateral free end portion 3 is secured to the upper is adjustable in nature, that is to say, a securing means which provides for user adjustment of the length and/or tension applied to said lateral free end portion 3 followed by securing of said lateral free end portion 3 to the upper while in the user adjusted condition. Many such securing means are known in the art and include such mechanical devices as buckles, clasps, double ring clasps, hooks and the like. However, a distinctly preferred adjustable securing means for use in the present invention, in terms of its relative unobtrusiveness and its uncomplicated and effective use, is a cooperative hook and loop fabric fastener device, such as sold under the VELCRO fastener brand name by Velcro USA Inc., Manchester, N.H. Such hook and loop fabric fastener devices comprise a pair of cooperative fabric elements, one element presenting a plurality of locking hooks projecting from one surface thereof and the second of said elements presenting a loop surface adapted to capture the hooks of the first element in releasable interlocking relationship therewith.

Upon exiting to the exterior of the upper 54 through aperture 66, the posterior arm member 7 of the orthotic cradle device 10 is directed posteriorly of said aperture 66 and is adjustably secured, by use of adjustable securing means of any of the types previously disclosed, or functional equivalents thereof, to the upper 54 at a spaced distance posteriorly of said aperture 66, and preferably at or posteriorly of that portion of the medial side of the heel 53 of upper 54 whereat said medial side begins to curve laterally toward the longitudinal center line of the heel. In the particular embodiment of the invention shown in the drawing, the adjustable securing means for the lateral free end portion 3 of the base leg member 1 and the posterior arm member 7 are each of the hook and loop fabric type fasteners previously mentioned. Separate and distinct hook or loop fabric tab elements 3' and 7' are secured to the respective free ends of lateral free end portion 3 and posterior arm member 7 of the orthotic cradle device 10. A single elongate cooperative loop or hook fabric element 37, serves each of said tab elements 3' and 7', said elongate element 37 being secured to the heel 53 and extending forwardly from the centerline thereof along the lateral and medial sides of the upper 54.

Upon exiting to the exterior of the upper through the slotted aperture 68, the anterior arm member 5 of the orthotic cradle device 10 is directed laterally, over the medial longitudinal arch, and is provided with adjustable securing means whereby it may be adjustably secured to the upper at a location sufficiently lateral of the aperture 68 as to capture at least the apex of the medial longitudinal arch thereunder. Preferably as shown particularly in FIGS. 3 and 4, that portion of the anterior arm member 5 lying exterior of the aperture 68 is carried completely over the medial longitudinal arch and lateral longitudinal arch and is adjustably secured to the lateral side of the upper at a location lateral to the lateral longitudinal arch. Utilizing this preferred embodiment of the invention, said anterior arm member not only fulfills its principal orthotic functions with respect to the medial longitudinal arch, but also supports, controls and restores the lateral longitudinal arch and, because it is disposed over the lacing 58 and is secured laterally thereof in a tensioned state, serves to prevent untying or loosening of the lacing 58. As previously, substantially any adjustable securing means suitable to the task can be utilized to adjustably secure the anterior arm member 5 to the upper 54. However, as before, we prefer the use of a hook and loop fabric fastener and, to this end, as shown in the drawing, the free end of anterior arm member 5 has secured thereto a hook or loop fabric tab 5', while a cooperative hook or loop fabric patch 70 is secured to the dorso-lateral side of the upper 54.

Figure 5:
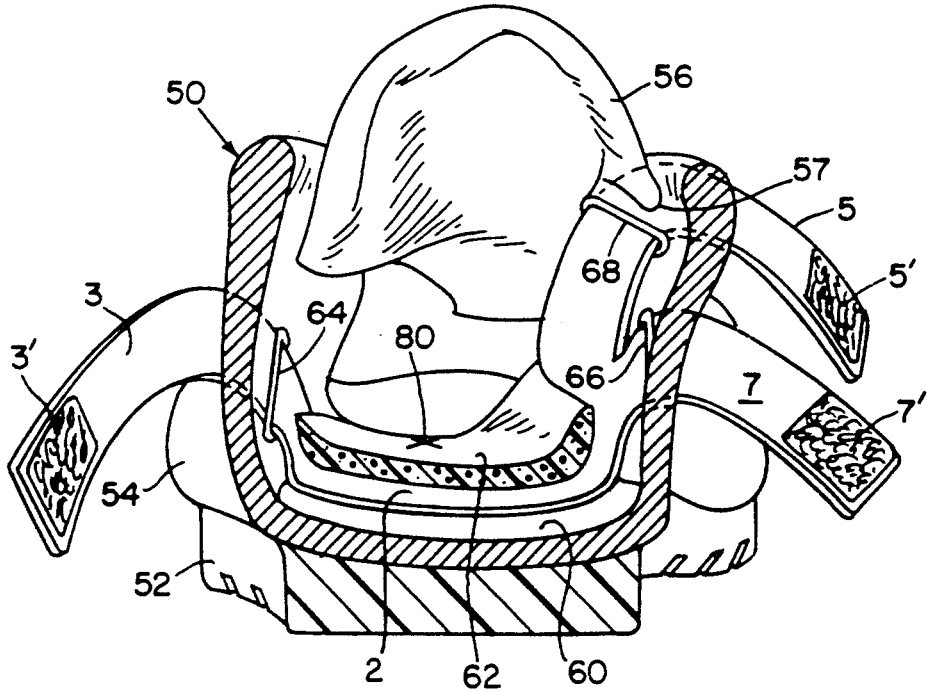
FIG. 5 hereof is a cross sectional rear view of the athletic shoe of FIG. 2, taken through lines 5—5' thereof, showing the shoe unlaced and with the free end portions of the strap members of the orthotic cradle device thereof in an unsecured condition.
Figure 2:
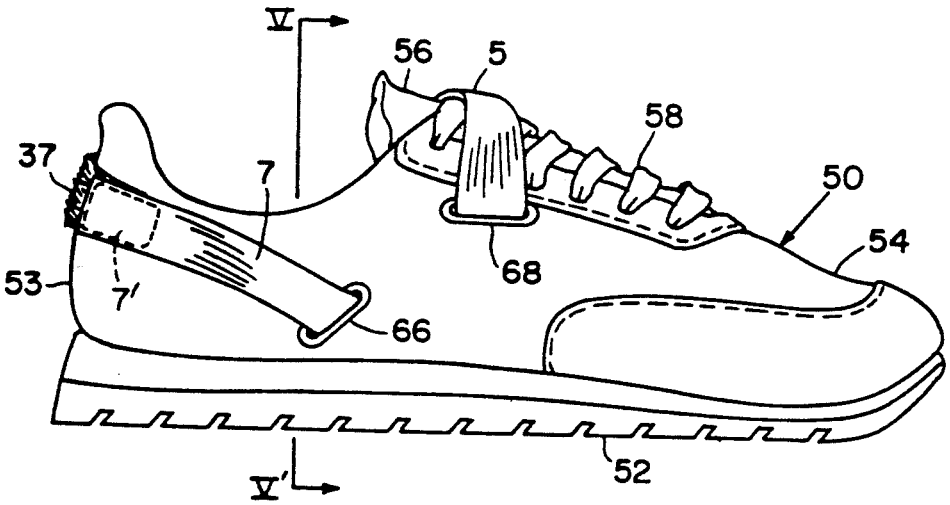
FIG. 2 hereof is a medial side view of a left athletic shoe equipped with the orthotic cradle device of FIG. 1.
Figure 3:
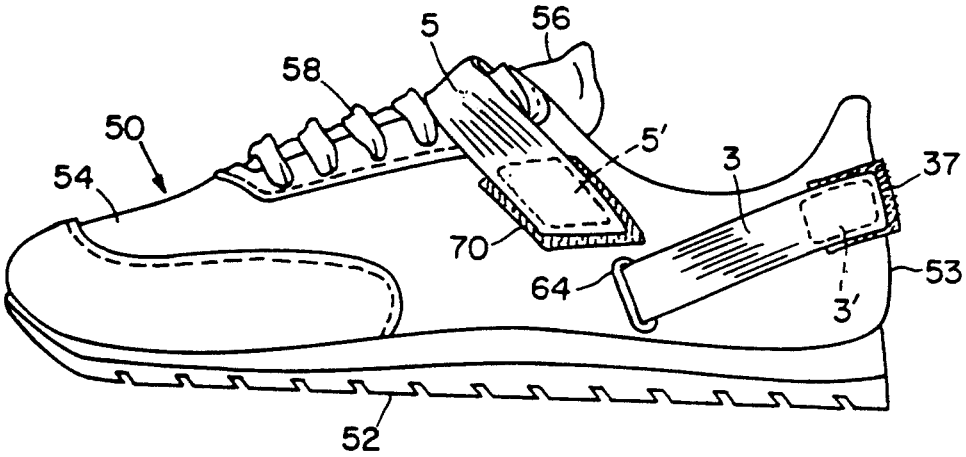
FIG. 3 hereof is a lateral side view of the athletic shoe of FIG. 2.
Figure 4:
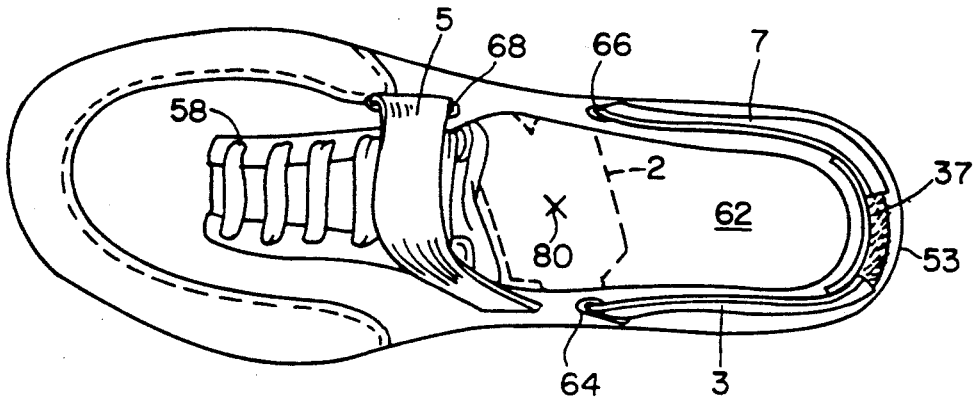
FIG. 4 hereof is a top view of the athletic shoe of FIG. 2.

With reference now to that portion of the orthotic cradle device residing within the upper 54 of the shoe 50, the relatively wide medial plantar support portion 2 of base leg member 1 lies obliquely transverse across the floor of the shoe, as may be best appreciated by reference to the cross sectional depiction of FIG. 5 and to the top view of FIG. 4 wherein said support portion 2 of the orthotic cradle device is shown in phantom. Where the shoe 50 comprises a removable molded foot bed 62, composed of a resilient cellular polymeric material, it is optional, but desirable, that the relatively wide plantar support portion 2 of the leg member 1 run under said foot bed 62, thereby to trap that portion of said foot bed 62 disposed under the plantar fascia of the foot between said plantar support portion 2 and the foot. In so disposing the plantar support portion 2 under the foot bed 62, said plantar support portion 2 also acts to urge said foot bed into improved conformity with and support of the plantar region of the foot and, in addition, effectively enlists the energy storage and return capability of that portion of the resilient foot bed residing between the plantar support portion 2 of the cradle device 10 and the foot such that it can more effectively apply such stored energy and return it to the foot. In another preferred embodiment of the invention, the plantar support portion 2 of the leg member 1, irrespective of whether it runs under or above the foot bed 62, if present, is secured thereto, such as by means of an adhesive dab or a tack stitch 80. In this manner, relative motion between the foot bed 62 and the floor of the shoe 50 during use can be reduced and, perhaps of greater significance, the orthotic cradle device 10 and foot bed 62 can be removed together from the shoe 50, for cleansing or other maintenance purposes, while preserving the proper geometric relationship therebetween upon reinstallation of the so secured cradle 10/foot bed 62 combination.

That section of the lateral free end portion 3 of leg member 1 residing within the shoe 50 courses upwardly to aperture 64 along the inside of the lateral side wall of the upper 54. Similarly, the sections of the anterior and posterior arm member 5 and 7 residing within the shoe 50 course upwardly to their respective apertures 68 and 66. Accordingly, said sections of the lateral free end portion 3, anterior arm member 5 and posterior arm member 7 residing within the shoe 50, taken with the plantar support portion 2 of the leg member 1, together define the internal orthotic cradle device of the invention. Said cradle functions to support, control, stabilize and restore substantially the entire plantar anatomy of the foot in contact therewith, including the lateral and medial aspects thereof. Additionally it at least partially attenuates the mechanical shock of heel strike and weight bearing and distributes the weight bearing loads more uniformly throughout the plantar anatomy. Secondarily, the cradle splays the plantar fat pad along the tranverse plane to the medial longitudinal arch whereat the weight bearing forces upon the foot tend to exert their maximum deforming effect. By its actions, the orthotic cradle device of the invention urges the anatomy of the mid foot into a conformation whereat the foot's natural shock absorptive properties are best realized. Additionally, particularly with respect to those sections of anterior and posterior arm members residing within the shoe, said obliquely oriented arm member sections serve to control medial talar head excursion while increasing weight bearing efficiency of the foot through cohesivehess and fostering of joint neutrality. In carrying out gait analyses on several individuals with and without use of the present invention, it was discovered that use of the present invention tended to result in substantially improved gait patterns. In those instances where improved gait patterns were ascertained, the types of improvements noted appeared to result from the internal sections of the anterior and posterior arm members 5 and 7 acting directly upon the foot in a manner such as to mitigate against excessive motion at the midtarsal and navicular-cuneiform joints and the exteral section of the anterior arm member 5 acting to stabilize and restore the medial longitudinal arch.

Those sections of the lateral free end portion 3 of arm member 1 and posterior arm member 7 which reside exteriorly of their respective apertures 64 and 66, when adjusted and secured to the upper, posteriorly of said apertures, define a bilateral control mechanism whereby: aberrant lateral-medial angular excursions of the calcaneus under weight bearing conditions are retarded; the hind foot is secured within the shoe 50 so as to mitigate against excessive motion therewithin and, in consort with the internal elements of the orthotic cradle device 10, the calcaneus can be urged under the non-weight bearing conditions of the swing phase into its optimum preload position.

The section of the anterior arm member 5 exterior of its receiving aperture 68, when disposed laterally over the medial longitudinal arch, adjusted and secured in its adjusted condition to the upper 54 at a location sufficiently lateral of aperture 68 as to capture at least the apex of the medial longitudinal arch thereunder, acts to support, control and restore the medial longitudinal arch. Where said exterior section is disposed and secured to the lateral side of the upper, laterally of the lacing 58 as is shown in the drawing and as represents a preferred embodiment of the invention, said section can also capture the lateral longitudinal arch of the foot thereunder and can provide the additional benefits of supporting, controlling and restoring the lateral column of the foot so as to minimize or avoid subluxation of the calcaneal-cuboid joint and/or cuboid dislocations. Acting in consort with the internal orthotic cradle 10, said exterior section of the anterior arm member 5 shortens the medial longitudinal arch, thereby serving to decrease the weight bearing stress applied to the plantar anatomy. It also provides improved medial column stability, thereby allowing the first ray (first metatarsal) to purchase the support surface more efficiently. The energy stored as a consequence of its retardation of excessive motion of the medial longitudinal arch is returned to the foot and is so directed as to aid resupination thereof.

In preparation for use the foot is inserted into the shoe 50, the lacing closure 58 tensioned and tied and each of the exterior sections of the lateral free end portion 3, anterior arm member 5 and posterior arm member 7 of the orthotic cradle device 10 suitably adjusted by the wearer such that comfortable support of the mid and hind foot is achieved and said sections are then secured in their adjusted positions to the exterior of the upper 54, at the locations indicated therefor. Upon completion of the securing steps, there is established an orthotic cradle device 10 which dynamically interacts with the triplanar fulcrum defined by the shoe 50. Particularly where the orthotic cradle device 10 is formed of an elastic fabric material, as is preferred, it is generally the case that said cradle device is sufficiently accomodating of the foot so as to maintain comfortable support of the foot during the course of its use during an energetic user activity period, thereby avoiding the necessity for repeated adjustment thereof during or after such activity period.

While the detailed description of the invention appearing hereinbefore has been specifically directed to the construction of a left hand shoe, it is abundantly obvious that several of the constructional details set forth above are to be reversed with respect to a right hand shoe and that the essential anatomical loci set forth above remain valid, irrespective of the handedness of the shoe in question.

Although certain representative embodiments and details have been shown and discussed for the purpose of illustrating the invention, it will be apparent to those skilled in the art that various substitutions or equivalents, modifications and changes may be made therein without departing from the essential scope and spirit of the invention.

What is claimed is:

1. A shoe equipped with an internal orthotic cradle device and comprising:

(A) a shoe having a sole and a foot-enclosing upper affixed thereto, said upper having lateral and medial sides and a longitudinal center line and being adapted to enclose at least one of the mid foot and hind foot of a wearer, said upper having a strap-receiving aperture therethrough in at least approximate correspondence with each of the following anatomical loci of a foot received therein: (i) proximal and superior to the lateral aspect of the calcaneal-cuboid joint, (ii) dorsomedial aspect of the medial longitudinal arch, and (iii) medial aspect of the calcaneous inferior to the medial malleolous;

(B) a generally Y-shaped orthotic cradle composed of strap members disposed within said upper, said cradle comprising a base leg member defining a plantar-lateral heel engagement strap, an anterior arm member defining a medial longitudinal arch engagement strap and a posterior arm member defining a plantar-medial heel engagement strap;

said base leg member comprising a relatively wide plantar support portion having a medial end and a relatively narrower lateral free end portion, said relatively wide plantar support portion being disposed obliquely transverse across the floor of the shoe and said lateral free end portion passing upwardly along the inside of the lateral side of the upper and slidingly passing to the exterior thereof through said aperture of (A)(i), and means to secure that section of said free end portion exterior of said aperture of (A)(i) to the lateral side of said upper at a location spaced posteriorly of said aperture and to thereby engage the lateral heel;

said anterior arm member having one end thereof secured at an anterior angle to the medial end of said relatively wider plantar support portion of said base leg member and passing therefrom upwardly and forwardly along the inside of the medial side of the upper and slidingly passing to the exterior thereof through said aperture of (A)(ii), that section of said anterior arm member exterior of said aperture being adapted to be disposed laterally over the medial longitudinal arch of the foot, and means to adjustably secure the free end thereof to the upper at a location sufficiently lateral of said aperture of (A)(ii) as to capture the apex of the medial longitudinal arch of the foot thereunder and to thereby engage the medial longitudinal arch;

said posterior arm member having one end thereof secured at a posterior angle to the medial end of said relatively wider plantar support portion of said base leg strap member and passing therefrom posteriorly and upwardly along the inside of the medial side of the upper and slidingly passing to the exterior of the upper through said aperture of (A)(iii), and means to adjustably secure the free end of that section of said posterior arm member exterior of said aperture of (A)(iii) to the medial side of said upper at a location spaced posteriorly of said aperture and to thereby engage the medial heel.

2. The shoe of claim 1 wherein said shoe is an athletic shoe.

3. The shoe of claim 1 wherein said shoe comprises a a removable foot bed composed of a resilient cellular elastomeric material.

4. The shoe of claim 3 wherein said relatively wider plantar support portion of said base leg member is disposed under said removable foot bed.

5. The shoe of claim 3 wherein said relatively wider plantar support portion of said base leg member is secured to said removable foot bed.

6. The shoe of claim 3 wherein said shoe is an athletic shoe.

7. The shoe of claim 1 wherein each of said means to adjustably secure the free ends of said strap members of said orthotic cradle to said upper is a hook and loop fabric fastener.

8. The shoe of claim 1 wherein said cradle is conformed of an elastic fabric material.

9. The shoe of claim 8 wherein said elastic fabric material has an ultimate elongation under load of between about 110 and about 120%.

10. The shoe of claim 1 wherein said means to secure the exterior section of said free end portion of said base leg member to the lateral side of said upper includes means for adjustably securing the free end portion to said lateral side.

11. The shoe of claim 10 wherein said means to adjustably secure said exterior section of said free end portion of said base leg member to the lateral side of said upper is a hook and loop fastener.

12. The shoe of claim 1 wherein said means to secure said exterior section of said free end portion of said base leg member to the lateral side of said upper and said means to adjustably secure the free end of said posterior arm member to the medial side of said upper are each located posteriorly of that portion of the heel of the upper whereat said lateral and medial sides begin to curve arcuately toward the longitudinal center line of the heel.

13. The shoe of claim 12 wherein said means to secure said exterior section of said free end portion of said base leg member to the lateral side of said upper includes means for adjustably securing the free end portion to said lateral side.

14. The shoe of claim 1 wherein said relatively wide planter support portion of said base leg member has a width of between about. 1.5 and 3 inches.

15. The shoe of claim 14 wherein said lateral free end portion of said base leg member has a width of between about 0.5 and about 1 inch.

16. The shoe of claim 1 wherein said anterior arm member has a width of between about 1.75 and about 3 inches.

17. The shoe of claim 1 wherein said shoe comprises a lacing closure of the upper disposed along the longitudinal center line thereof, wherein that section of said anterior arm member exterior of said aperture of (A)(ii) is adapted to be disposed laterally over the proximal end portion of said lacing and wherein said means to adjustably secure the free end of said exterior section of said anterior arm member to the upper is located laterally of said lacing closure whereby, upon adjustment and securing of said free end of said exterior section of said anterior arm member to said securing means, said proximal end portion of said lacing closure is disposed and thereby secured thereunder.

18. The shoe of claim 1 wherein that section of said anterior arm member exterior of said aperture of (A)(ii) is adapted to be disposed laterally over the medial longitudinal arch and the lateral longitudinal arch of the foot and wherein said means to adjustably secure the free end of said exterior section of said anterior arm member to said upper is located laterally of said lateral longitudinal arch, said thusly adjusted and secured exterior section of said anterior arm member thereby engaging both the medial and lateral longitudinal arches of the foot.

* * * * *